US007506468B2

(12) United States Patent
Farrell et al.

(10) Patent No.: US 7,506,468 B2
(45) Date of Patent: Mar. 24, 2009

(54) METHOD AND APPARATUS FOR MONITORING HANDLING OF A FIREARM

(76) Inventors: Michael Anthony Farrell, 208 W. Mountain Sage Dr., Phoenix, AZ (US) 85045; Calin William Brabandt, 8790 NW. Springville Ct., Portland, OR (US) 97231

( * ) Notice: Subject to any disclaimer, the term of this patent is extended or adjusted under 35 U.S.C. 154(b) by 255 days.

(21) Appl. No.: 11/497,436

(22) Filed: Aug. 2, 2006

(65) Prior Publication Data

US 2008/0032268 A1 Feb. 7, 2008

(51) Int. Cl.
*F41A 17/46* (2006.01)
*F41A 17/00* (2006.01)

(52) U.S. Cl. ..... 42/70.06; 42/70.01

(58) Field of Classification Search ..... 42/70.01, 42/70.02, 70.03, 70.04, 70.05, 70.06, 70.07, 42/70.08, 70.09, 70.11
See application file for complete search history.

(56) References Cited

U.S. PATENT DOCUMENTS 4,457,715 A 7/1984 Knight et al.
4,488,370 A * 12/1984 Lemelson ..... 42/70.01
4,719,713 A 1/1988 Hagle
5,451,162 A 9/1995 Parsons
5,560,133 A 10/1996 Kuebler
6,286,242 B1 * 9/2001 Klebes ..... 42/84
6,293,039 B1 * 9/2001 Fuchs ..... 42/70.11
6,305,941 B1 * 10/2001 Kotsiopoulos et al. ..... 434/11
6,321,478 B1 * 11/2001 Klebes ..... 42/84
6,481,140 B1 * 11/2002 Marshall ..... 42/70.11
6,499,243 B1 * 12/2002 Herzog ..... 42/70.07
6,678,984 B1 * 1/2004 Rapp et al. ..... 42/70.11
6,718,679 B2 * 4/2004 Herzog ..... 42/70.07
6,785,995 B2 * 9/2004 Herzog et al. ..... 42/70.07
6,823,621 B2 * 11/2004 Gotfried ..... 42/70.06
6,862,829 B2 3/2005 McMoore
7,030,729 B2 * 4/2006 Albanesi et al. ..... 340/5.61
2002/0112390 A1 * 8/2002 Harling et al. ..... 42/70.11

* cited by examiner

*Primary Examiner*—Bret Hayes
(74) *Attorney, Agent, or Firm*—Edell, Shapiro & Finnan, LLC

(57) ABSTRACT

A firearm monitoring system according to the present invention senses the position of a user hand or trigger finger on a weapon and generates a warning, notification, status or control signal when the user finger position is proximate the trigger. One embodiment generates and conditions an excitation stimulus (e.g., interrupted by the presence of a trigger actuator), drives a sensor with that stimulus, detects the user finger position through a change in the sensor output, and generates an appropriate signal for a downstream warning or other device (e.g., alarm, radio unit, laser sighting system, etc.). In this embodiment, the sensor may detect the presence of an object or finger penetrating a trigger guard plane. Another embodiment utilizes a set of sensors to detect the placement of a user trigger finger relative to the trigger. In addition, various types of output alarms may be utilized (e.g., visual and audio alarms, etc.).

35 Claims, 6 Drawing Sheets

METHOD AND APPARATUS FOR MONITORING HANDLING OF A FIREARM

BACKGROUND OF THE INVENTION

1. Technical Field

The present invention pertains to firearms and firearm training devices. In particular, the present invention pertains to a firearm monitoring device that senses the position of a user hand or trigger finger relative to the firearm trigger. In the case of a training application or embodiment, the monitoring device produces an alarm in response to detecting incorrect handling of the firearm (e.g., incorrect position of the user hand or trigger finger relative to the firearm trigger). When employed with an actual firearm, the monitoring device may alternatively transmit a warning message in response to detection of the user hand or trigger finger near the firearm trigger to notify personnel associated with the user (e.g., law enforcement, military, etc.) that the user is in a situation likely to result in discharge of the user firearm (e.g., accidental discharge when the user hand or finger placement is unintentional, combat, shootout, engaging a dangerous suspect, etc.).

2. Discussion of Related Art

Several police officers and civilians are injured or killed by accidental discharges from firearms each year. Many of these accidental discharges can be traced to improper placement of the trigger finger when the firearm is drawn or used to cover an individual. The trigger finger should always be placed outside the trigger guard of the firearm until the shooter is ready to pull the trigger and actuate the firearm. Ideally, the trigger finger should rest parallel to the barrel just above the trigger guard. Although this proper placement is emphasized during firearm training, numerous poor habits may develop for several reasons. For example, a plastic training weapon is typically employed to simulate an actual firearm during defensive tactics training (e.g., self defense, hand to hand combat, etc.). When the firearm is used as a blunt object or striking weapon for defensive tactics, the most comfortable place for the trigger finger is inside the trigger guard. Since the plastic training device does not actually discharge, this placement does not seem dangerous. However, the problem develops when this technique is transferred to an actual weapon that may discharge. For example, when a police officer is utilizing a firearm to guard a suspect with the officer trigger finger placed inside the trigger guard, there is a great risk of an accidental discharge.

Further, a phenomenon exists, commonly referred to as "sympathetic reflex", where one hand performs a gripping motion or grips an object and the other hand tends to perform the same action unless commanded to conduct a different task. Thus, if an officer with a firearm drawn grabs at a suspect with one hand while the other hand or finger is placed within the trigger guard, the trigger quite possibly may be actuated consequently discharging the firearm.

Moreover, poor habits may be developed on a shooting range. In particular, most shooting courses utilized by law enforcement provide timed exercises or drills with the elapsed time starting the moment a target faces a shooter. The shooter subsequently draws a firearm and fires a set amount of rounds into the target in the allotted time interval (e.g., three shots/four seconds, etc.). Due to the time constraints and point system utilized by these types of exercises in combination with the certainty of actuating the firearm (unlike the majority of real world scenarios), many shooters place their trigger finger into the trigger guard while the firearm is brought to the ready position. These actions result in an incorrect technique since the trigger finger should only enter the trigger guard when the shooter is ready to shoot.

In addition, a firearm user may intentionally or unintentionally position their hand or finger into the firearm trigger guard. This action produces a situation containing high physical risk to the user and bystanders since discharge of the firearm is likely. However, the risk is often unapparent to those affected, or unknown to others that may be able to lend assistance to diffuse the situation (e.g., law enforcement officers in the field, police dispatch, military, etc.).

OBJECTS AND SUMMARY OF THE INVENTION

Accordingly, it is an object of the present invention to monitor handling of a firearm.

It is another object of the present invention to detect and indicate improper handling of a firearm during firearm training.

Yet another object of the present invention is to alert shooters, firearm training instructors or other parties when a shooter trigger finger is placed near the firearm trigger.

Still another object of the present invention is to employ a firearm monitoring device that trains users to handle a firearm with proper technique.

A further object of the present invention is to detect and indicate the proper position of a user trigger finger relative to a firearm trigger guard during firearm training.

Yet another object of the present invention is to monitor user handling of a firearm and transmit a warning message in response to determining that the user is engaged in a situation likely to result in discharge of the firearm (e.g., accidental discharge when the user hand or finger placement is unintentional, combat, shootout, engaging a dangerous suspect, etc.).

Still another object of the present invention is to monitor user handling of a firearm and provide a warning message to affiliated personnel (e.g., law enforcement, military, etc.) in response to detecting placement of the user hand or finger near the firearm trigger.

The aforesaid objects may be achieved individually and/or in combination, and it is not intended that the present invention be construed as requiring two or more of the objects to be combined unless expressly required by the claims attached hereto.

According to the present invention, a firearm monitoring system senses the position of a user hand or trigger finger on a weapon and generates a warning, status or control signal when the position of a user finger is in the proximity of a weapon trigger (e.g., the trigger of an actual weapon, training weapon, or other trigger actuated device). The present invention ensures generation of the warning signal in response to actuation or "firing" of the weapon or device, either intentionally or unintentionally, based on the detected position of interest. One embodiment of the present invention system generates and conditions an excitation stimulus (e.g., that is interrupted or modified by the presence of a finger or trigger actuator), drives a finger position sensor with the excitation stimulus, detects the position of the user finger through a change in the output of the finger position sensor (e.g., detects a change in the excitation stimulus, while rejecting sources of noise external to the system, and conditions an electrical output that varies with a change in the stimulus), and generates a signal with timing properties appropriate for the input requirements of a downstream warning, recording, notification, or control system (e.g., sighting system with laser transmission (e.g., red-dot), radio unit, etc.). The generation of the excitation stimulus may be performed by a modulator to generate a signal that the finger position sensor may discern from noise in the environment. In this embodiment, the sensor is employed within or near the region of the trigger guard and positioned and oriented to detect the presence of an object or finger penetrating the plane of the trigger guard.

Another embodiment of the present invention utilizes a set of sensors to detect the placement of a user trigger finger relative to the trigger. In addition, various types of output alarms may be utilized (e.g., visual and audio alarms, etc.), or the alarm event may be transmitted and/or logged. For example, a warning message may be transmitted to affiliated personnel (e.g., law enforcement or a police dispatch, military, etc.) to automatically request assistance for the firearm user (e.g., police officer, soldier, etc.).

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1:
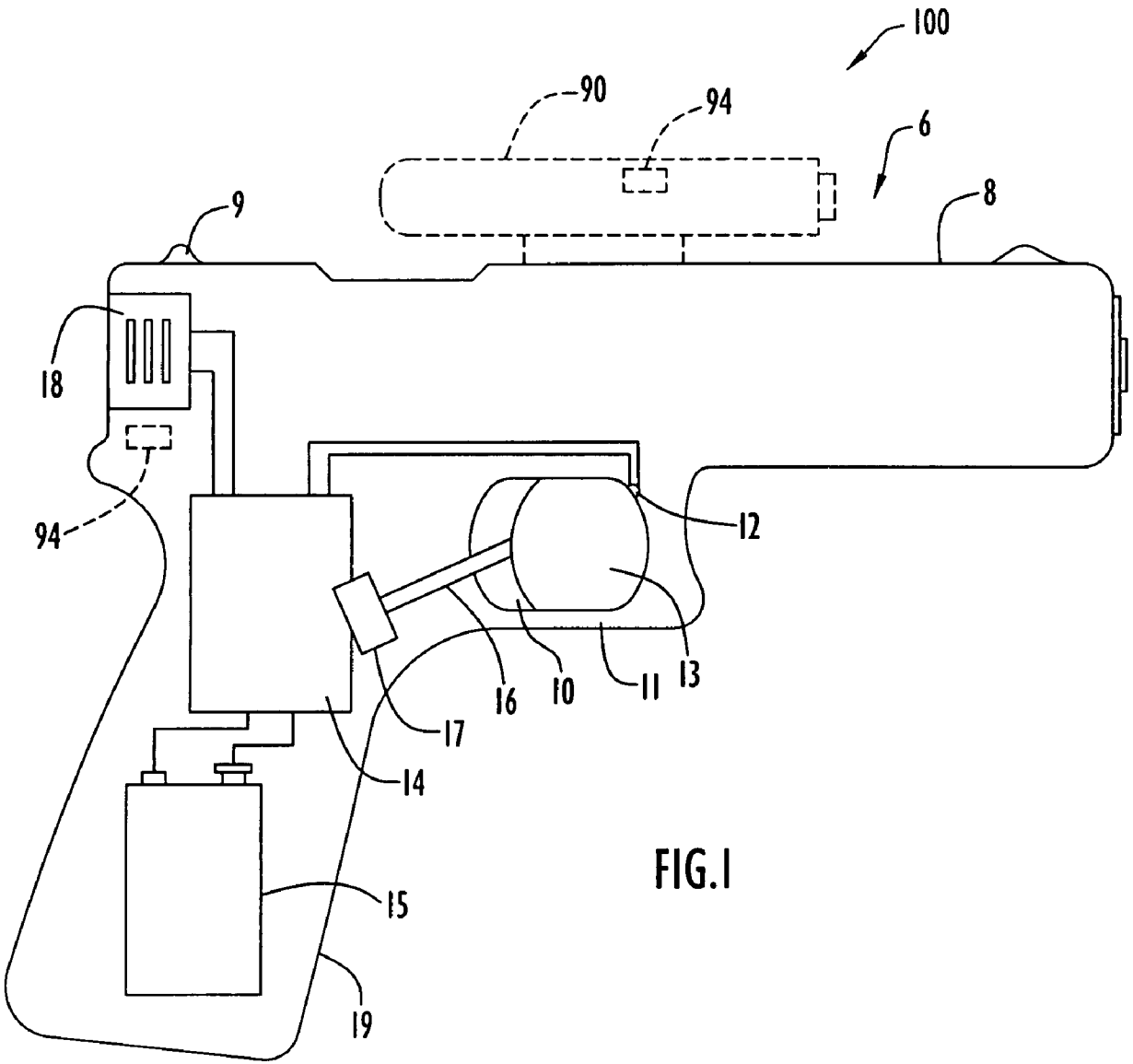
FIG. 1 is a view in elevation of an exemplary firearm employing the firearm monitoring system according to the present invention.

An exemplary firearm employing a firearm monitoring system according to the present invention is illustrated in FIG. 1. The firearm monitoring system senses the position of a user hand or trigger finger and produces an alarm in response to detecting the trigger finger in the proximity of the trigger. In the case of a training application or embodiment, the monitoring system produces an alarm in response to detecting incorrect handling of the firearm (e.g., incorrect position of the user hand or trigger finger relative to the firearm trigger). When employed with an actual firearm, the monitoring system may alternatively transmit a warning message in response to detection of the user hand or trigger finger near the firearm trigger to notify personnel associated with the user (e.g., law enforcement, military, etc.) that the user is in a situation likely to result in discharge of the user firearm (e.g., accidental discharge when the user hand or finger placement is unintentional, combat, shootout, engaging a dangerous suspect, etc.).

Specifically, firearm monitoring system 100 includes a light source 12, a circuit board 14 including control circuitry, a power source or battery 15, a tubular member 16, a light detector 17 and an alarm unit 18. By way of example only, firearm 6 is implemented by a conventional hand-gun and includes a barrel 8, a hammer 9, a trigger 10 disposed within a trigger guard 11 and a grip 19. Further, the firearm monitoring system may include or be coupled to a conventional laser sighting system 90 and/or a radio unit 94. The laser sighting system may be disposed above barrel 8 to project a laser beam indicating a potential impact location due to firearm actuation. The radio unit (and associated circuitry) may be disposed within firearm 6 adjacent alarm unit 18 or, alternatively, may be disposed within a firearm accessory, such as laser sighting system 90, to transmit a warning message or distress signal as described below. The radio unit is preferably implemented by a conventional low power transmitting device (e.g., for short distance transmissions) with suitable dimensions for placement within the firearm or a firearm accessory (e.g., laser sighting system, etc.), but may be implemented by any suitable conventional or other radio, transmitting and/or transceiving device. In any event, the firearm may be implemented by any conventional actual or mock firearms (e.g., hand-gun, rifle, shotgun, etc.).

Light source 12 is disposed within the upper distal portion of trigger guard 11 and is oriented to transmit a light beam into an interior area 13 of the trigger guard. The light source is preferably implemented by a conventional infrared (IR) light emitting diode (LED) producing a non-visible light beam, but may be implemented by any suitable light or other energy source (e.g., laser, sound, RF, magnetic, etc.). Light source 12 is coupled to and controlled by control circuitry on circuit board 14. The circuit board receives and distributes power from power source or battery 15.

Tubular member 16 is disposed within an intermediate portion of trigger 10, preferably in the forward or distal face of the trigger, and is positioned and geometrically oriented with respect to light source 12 to receive the light beam generated by the light source while rejecting sources of light noise and interference (e.g., indirect or extraneous light emissions, etc.). Light detector 17 is disposed at the proximal end of the tubular member to detect the received light beam from light source 12. The light detector is preferably implemented by a conventional infrared (IR) light detector, but may be implemented by any suitable light or other energy detector (e.g., laser, sound, RF, magnetic, etc.).

The tubular member may be constructed of any suitable materials, and is typically hollow or includes a channel (not shown) of sufficient dimensions to enable a light beam from light source 12 to pass therethrough for detection by light detector 17. The tubular member is disposed within the firearm and extends from trigger 10 through firearm grip 19 toward circuit board 14. The interior of the tubular member is preferably dark in color or black. This enables the tubular member to reject or absorb environmental light emissions from extraneous sources, thereby allowing light emitted by light source 12 to pass from the entrance of the tubular member to light detector 17 disposed at the tubular member proximal end as described above.

The light source and tubular member (and, hence, light detector 17) are disposed at opposing sides of trigger guard internal area 13 to provide and detect the presence of a light beam transmitted across that area, thereby enabling detection of the presence of a user finger. In particular, the positioning and alignment of the tubular member with the light source enables a significant portion of light energy reaching the light detector to be interrupted by the presence of a user finger or other mechanical obstruction within internal area 13 of trigger guard 11. The change in light energy reaching light detector 17 results in a change in the electrical output of the light detector. Control circuitry of circuit board 14 detects this change in the light detector output, generates output timings appropriate for alarm unit 18, laser sighting system 90 and/or radio unit 94, and drives the alarm unit, laser sighting system and/or radio unit to indicate the detected condition as described below.

Alarm unit 18 is preferably implemented by a buzzer, but may be implemented by any suitable audio and/or visual indicator (e.g., LED, buzzer, speaker, display, etc.). The alarm unit is disposed at the proximal end of the firearm toward hammer 9 and is coupled to circuit board 14. When a user incorrectly handles firearm 6 during training by prematurely placing a user finger in the trigger guard, the finger placement interrupts a light beam transmitted from light source 12 toward tubular member 16 (and, hence, light detector 17) as described above. This beam interruption is detected by the control circuitry and an alarm may be produced by alarm unit 18 to indicate improper handling of the firearm. Further, the firearm monitoring system may actuate laser sighting system 90 to produce a laser transmission (e.g., red-dot, etc.) to indicate improper handling of the firearm during training (e.g., improper placement of the user trigger finger, etc.). The laser sighting system is coupled to circuit board 14.

When employed with an actual firearm, the monitoring system may alternatively transmit a warning message or distress signal in response to detection of the user hand or trigger finger near the firearm trigger to notify personnel associated with the user (e.g., law enforcement, military, etc.) that the user is in a situation likely to result in discharge of the user firearm (e.g., accidental discharge when the user hand or finger placement is unintentional, combat, shootout, engaging a dangerous suspect, etc.). In this case, radio unit 94 relays a warning message or distress signal to affiliated personnel of the user (e.g., law enforcement, military, etc.) to indicate that the user is in a situation likely to result in discharge of the firearm. The message or signal is preferably in the form of, or includes, a digital or other code identifying the situation, but may include any desired information. For example, radio unit 94 may transmit a warning message to police radio equipment (e.g., in a nearby vehicle) for forwarding to a police dispatch (e.g., dispatch communications equipment) or other officer radio units in order to enable police to send assistance. The radio unit is coupled to circuit board 14.

Firearm 6 may be implemented as a mock or training firearm with the components of the firearm monitoring system (e.g., light source 12, tubular member 16, light detector 17, circuit board 14, battery 15, alarm unit 18, laser sighting system 90, etc.) mounted on and/or within the firearm components (e.g., trigger 10, trigger guard 11, grip 19, etc.) in the manner described above, and/or mounted on external surfaces of and/or adjacent corresponding firearm components (e.g., trigger 10, trigger guard 11, grip 19, etc.) to detect the presence of a user finger within the trigger guard area in the manner described above (e.g., with the light source and tubular member aligned, etc.). Alternatively, the firearm monitoring system components (e.g., light source 12, tubular member 16, light detector 17, circuit board 14, battery 15, alarm unit 18, laser sighting system 90, radio unit 94, etc.) may be mounted on external (and/or internal) surfaces of, and/or adjacent corresponding components of, an actual firearm or other weapon (e.g., trigger 10, trigger guard 11, grip 19, etc.) to detect the presence of a user finger within the trigger guard area in the manner described above (e.g., with the light source and tubular member aligned, etc.) to enable monitoring of an actual weapon (e.g., a user may train with their own firearm or other weapon, warning or distress messages may be sent during use of the firearm in the field, etc.).

Figure 2:
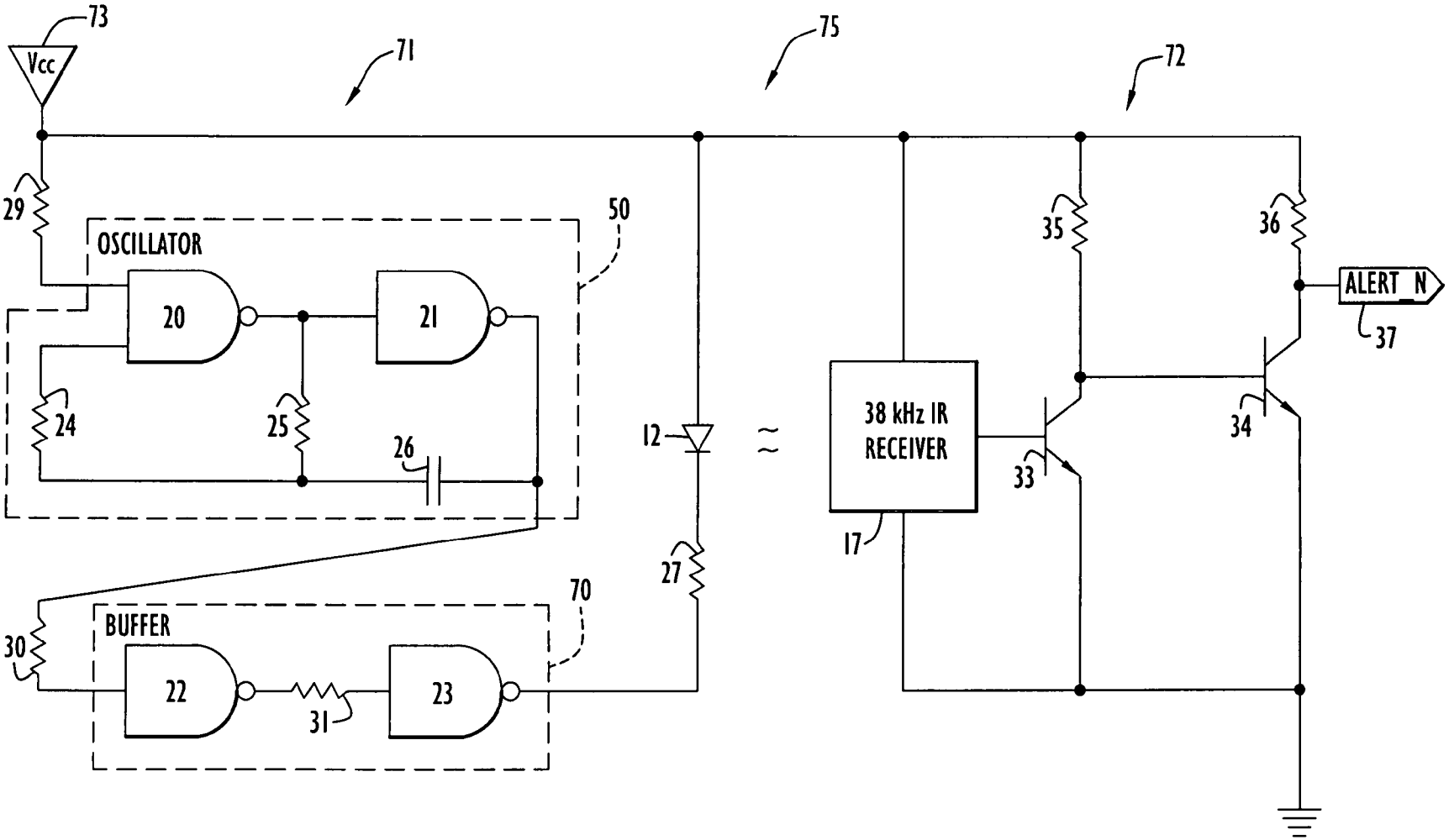
FIG. 2 is an electrical schematic diagram of the control circuitry of the firearm monitoring system of FIG. 1.
Figure 3:
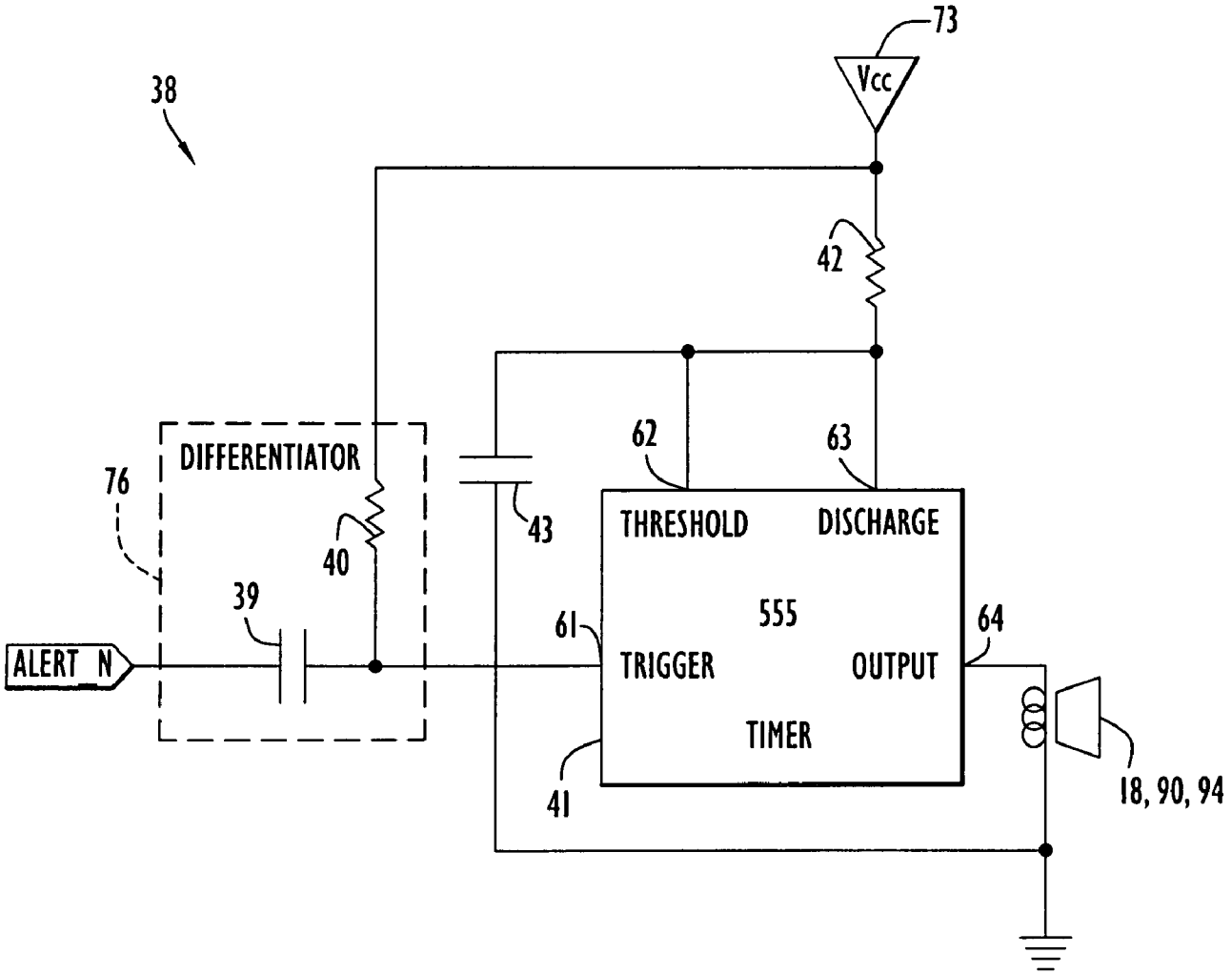
FIG. 3 is an electrical schematic diagram of the timing circuitry of the firearm monitoring system of FIG. 1 for driving an alarm unit or other device (e.g., laser sighting system, radio unit, etc.).

An exemplary control circuit of circuit board 14 for the firearm monitoring system according to the present invention is illustrated in FIG. 2. Control circuit 75 controls light source 12 and processes information from light detector 17 to generate a signal appropriate to drive alarm unit 18 or other device (e.g., laser sighting system 90, radio unit 94, warning device, control device, data logging or recording device, etc.). Specifically, control circuit 75 includes a transmission control circuit 71 to control emissions from light source 12, a reception control circuit 72 to process signals received from the light source and a timing circuit 38 (FIG. 3). Transmission control circuit 71 includes light source (or IR LED) 12, an oscillator 50 and a buffer 70. The oscillator includes NAND gates 20,21, resistors 24, 25 and a capacitor 26. An input of NAND gate 20 is coupled to a supply voltage 73 (Vcc; e.g., 5V DC) via a resistor 29, while the other NAND gate input is coupled to resistor 24 disposed within an oscillator feedback path. The output of NAND gate 20 is coupled to the inputs of NAND gate 21, where the output of NAND gate 21 is coupled to a feedback network including resistors 24, 25 and capacitor 26. Resistor 24 is coupled to an input of NAND gate 20 as described above, while resistor 25 is coupled to a junction between NAND gates 20, 21 and to resistor 24. Capacitor 26 is disposed between the output of NAND gate 21 and resistor 25. This feedback configuration is suitable to enable oscillator 50 to produce an output voltage varying at a frequency of approximately 38 KHz. Resistors 24, 25 and capacitor 26 may include any suitable characteristics (e.g., resistance, capacitance, etc.).

The output of oscillator 50 is coupled to a buffer 70 via a resistor 30. The buffer includes NAND gates 22, 23 and a resistor 31 disposed between the NAND gates. The output of oscillator 50 is coupled to the inputs of NAND gate 22, where the output of NAND gate 22 is coupled to the inputs of NAND gate 23 via resistor 31. NAND gates 22, 23 form a buffer and are coupled through a resistor 27 to light source (or a cathode of IR LED) 12. Resistor 27 may include any suitable characteristics (e.g., resistance, etc.).

NAND gates 20, 21, 22 and 23 may be implemented by a conventional single 74C00, 74AHC00, or 74HC00 quad NAND gate CMOS IC device. The quad NAND gate CMOS IC device and light source (or an anode of IR LED) 12 are coupled to and/or powered by supply voltage 73 (Vcc). Resistors 29, 30 and 31 limit the input current and quad NAND gate CMOS IC device power consumption, and respectively couple inputs of NAND gates 20, 22 and 23 to the previous stage or appropriate logic level. Resistors 29, 30 and 31 may include any suitable characteristics (e.g., resistance, etc.). Alternatively, the oscillator and buffer arrangement may be implemented by a conventional 555 timer used and configured as an oscillator to generate the output voltage varying at a frequency of approximately 38 KHz described above. This timer and timer 41 described below for timing and control logic circuitry 38 (FIG. 3) may be implemented on the same chip or integrated circuit in order to reduce the quantity of chips for the implementation.

Reception control circuit 72 includes light detector 17, an inverting transistor 33 and a transistor switch 34. Infrared light, produced by light source (or IR LED) 12 and modulated at a frequency of 38 KHz via oscillator 50, passes through internal area 13 (FIG. 1) of trigger guard 11 for reception by tubular member 16 and energizes light detector or receiver module 17 disposed at the proximal end of the tubular member as described above. The light detector may be implemented by a model type IRM-8601S available from Everlight Electronics Co., Ltd., and is sensitive to a center frequency of 38 Khz to match the frequency of the signal produced by light source (or IR LED) 12. The output voltage of light detector 17 is coupled to a base of inverting transistor 33, preferably an NPN type transistor. Inverting transistor 33 forms a voltage inverter with the transistor emitter coupled to ground and the collector coupled to supply voltage 73 (Vcc) via a resistor 35. Resistor 35 may include any suitable characteristics (e.g., resistance, etc.). The transistor switch is preferably an NPN type transistor with the base coupled to the collector of transistor 33, the emitter coupled to ground and a collector 37 coupled to supply voltage 73 (Vcc) via an output load or resistor 36.

If internal area 13 of trigger guard 11 between light source 12 and light detector 17 is unobstructed, the light detector output voltage is sufficient to bias inverting transistor 33 to conduct current from resistor 35 coupled to supply voltage 73 (Vcc) and reduce the voltage at the base of transistor switch 34 to approximately zero volts. This causes the transistor switch to enter an off state and produce a detector high output signal at collector 37 of transistor switch 34. However, when a user finger or other obstruction is present within internal area 13 of the trigger guard, the light signal transmitted between the light source and light detector is interrupted, thereby causing the voltage provided from light detector 17 to the base of inverting transistor 33 to be reduced to approximately zero volts. Consequently, the collector of inverting transistor 33 transitions to a high voltage, and bias current is supplied to the base of transistor switch 34 from resistor 35 coupled to supply voltage 73 (Vcc). This causes transistor switch 34 to saturate and supply power to output load or resistor 36, thereby producing a detector active low output signal at collector 37. Resistor 36 may include any suitable characteristics (e.g., resistance, etc.). Alternatively, alarm unit 18 or other warning device or indicator (e.g., buzzer, annunciator light, laser sighting system 90, radio unit 94, etc.) may serve as the output load and be driven by transistor switch 34 for actuation during the interval a user finger is detected within the trigger guard area as described below.

The output load resistance (or resistor 36) produces a detector active low output signal (e.g., alert_n as viewed in FIGS. 2-3) at collector 37 of transistor switch 34 in response to interruption of the light beam as described above. Collector 37 of transistor switch 34 is coupled to the input of timing and control logic circuitry 38 (FIG. 3) to provide the detector output signal to circuitry 38 and generate alert signals via alarm unit 18, laser sighting system 90 and/or radio unit 94. An exemplary timing and control logic circuit 38 of the firearm monitoring system according to the present invention is illustrated in FIG. 3. Specifically, circuitry 38 includes a timer 41 and a differentiator 76. The detector output signal remains active at a low voltage during interruption of the light beam from light source (or IR LED) 12 to light detector 17 as described above. Alert signal timing control is accomplished by initially conditioning the detector output active low signal through differentiator 76. The differentiator includes a capacitor 39 coupled to collector 37 of transistor switch 34 (FIG. 2) and a resistor 40 coupled between capacitor 39 and supply voltage 73 (Vcc). Capacitor 39 and resistor 40 may include any characteristics (e.g., resistance, capacitance, etc.) sufficient to provide a suitable RC time constant substantially less than the smallest desired alert duration interval, and convert the active low detector output signal to a negative pulse of short duration.

Differentiator 76 is coupled to timer 41. The timer may be implemented by a 555 timer IC configured in the monostable operating mode, and includes a trigger input 61, a threshold input 62, a discharge input 63 and a timer output 64. This type of device produces a high level logic signal at timer output 64 in response to receiving a sufficient signal on trigger input 61. The trigger input is activated by a low level signal (e.g., the detector active low output signal as conditioned by differentiator 76). The timer output signal remains in the high state until a sufficient signal is received on threshold input 62. Once this occurs, the timer output signal enters a low state. Alarm unit 18, laser sighting system 90 and/or radio unit 94 may be coupled to timer 41, where the timer output signal is utilized to drive the alarm unit, laser sighting system and/or radio unit (e.g., during high level logic states of the timer output: the alarm unit provides an alarm indication; the laser sighting system produces a laser beam or dot; and the radio unit transmits the warning message or distress signal).

Differentiator 76 is coupled to the trigger input of timer 41, while the timer threshold and discharge inputs are each coupled to supply voltage 73 (Vcc) through a resistor 42 and to ground via a capacitor 43. Resistor 42 and capacitor 43 may include any suitable characteristics (e.g., resistance, capacitance, etc.). While light detector 17 receives the beam transmitted from light source 12, a detector high output signal is generated by reception control circuit 72 (FIG. 2) and provided to differentiator 76 as described above. The resulting conditioned signal (e.g., a high signal) produced by differentiator 76 is applied to trigger input 61 of timer 41. Since this signal is insufficient to trigger timer 41 as described above, the timer produces a low level logic signal at timer output 64, thereby maintaining alarm unit 18, laser sighting system 90 and/or radio unit 94 in a disabled state.

However, during interruption of the beam generated by light source 12 (e.g., due to a user finger placed in the trigger guard area), a detector output active low signal is generated by reception control circuit 72 (FIG. 2) and provided to differentiator 76 for conditioning as described above. The resulting short duration or conditioned pulse (e.g., low or negative level) produced by differentiator 76 is applied to trigger input 61 of timer 41 (e.g., with capacitor 43 initially discharged), thereby controlling the timer to produce a high level logic signal at timer output 64 and drive alarm unit 18, laser sighting system 90 and/or radio unit 94 to provide an alarm or warning indication, a laser beam transmission and/or a warning or distress message transmission, respectively. Capacitor 43 begins charging toward the supply voltage (Vcc) and, upon reaching a sufficient level, provides a suitable signal on threshold input 62 (and discharge input 63) to cause timer 41 to produce a low level logic signal at timer output 64 and discharge capacitor 43 (e.g., to initialize the capacitor for the next cycle). The low level logic signal disables alarm unit 18, laser sighting system 90 and/or radio unit 94. The timer basically produces a positive pulse that drives alarm unit 18, laser sighting system 90 and/or radio unit 94 to respectively produce an alarm indication, a laser transmission and a warning message or distress signal transmission during the width of each pulse (e.g., the time interval a generated pulse remains in the high level logic state). The duration of the warning signal or transmission, generated by alarm unit 18, laser sighting system 90 and/or radio unit 94, is controlled by the characteristics of resistor 42 and capacitor 43 (e.g., controlling the charge time of the capacitor to trigger the threshold input). A variable resistance may be applied to timer 41 (e.g., resistor 42 may be a variable resistor, etc.) to control the charge time of capacitor 43 and enable adjustment of warning signal durations and transmissions (e.g., from zero (e.g., warning disabled) to several seconds, provide flash or beeps, etc.).

The alarm unit, laser sighting system and/or radio unit may alternatively serve as the output load within reception control circuit 72 and be driven by transistor switch 34. In this case, the alarm unit, laser sighting system and/or radio unit are actuated during the interval a user finger is detected within the trigger guard area. In addition, the control circuitry may alternatively include a processor (e.g., microprocessor, controller, etc.) to control transmissions by light source 12, process received signals by light detector 17, and produce appropriate signals to drive alarm unit 18, laser sighting system 90, radio unit 94 and/or other devices (e.g., for a predetermined time interval, during the interval a user finger is detected, etc.).

Operation of the firearm monitoring system is described with reference to FIGS. 1-3. Initially, transmission control circuit 71 controls light source 12 to transmit a modulated light beam across internal area 13 of trigger guard 11 toward tubular member 16 (and light detector 17) as described above. A user grips firearm 6 in an appropriate manner to perform a drill, exercise or other activity for training purposes, or in response to a situation arising when employed in the field. During the training activity, the user handles the firearm in a manner for firearm actuation. The proper procedure is to move the firearm into a ready position for firing with a user finger outside the trigger guard area. In the case of a situation in the field, the user may place the finger appropriately for discharge of the firearm.

While the user maintains the user finger outside the trigger guard area, light detector 17 receives the beam transmitted from light source 12 and a detector high output signal is generated by reception control circuit 72 (FIG. 2) as described above. The detector high output signal is provided to timing circuitry 38. Since this signal is insufficient to trigger the timing circuitry, the circuitry produces a low level logic signal to maintain alarm unit 18, laser sighting system 90 and/or radio unit 94 in a disabled state as described above.

However, when the user places a finger in the trigger guard area, the light beam transmitted by light source 12 is interrupted. Reception control circuit 72 senses the change in output from light detector 17 and produces a detector active low output signal that is provided to timing circuitry 38. The timing circuitry generates an appropriate waveform to drive alarm unit 18, laser sighting system 90 and/or radio unit 94 to provide a suitable indication (e.g., audio and/or visual, transmission, etc.) of the user finger placed proximate the trigger. This may indicate improper handling of the firearm during a training activity, or a situation in the field likely to result in discharge of the firearm by the user.

Figure 4:
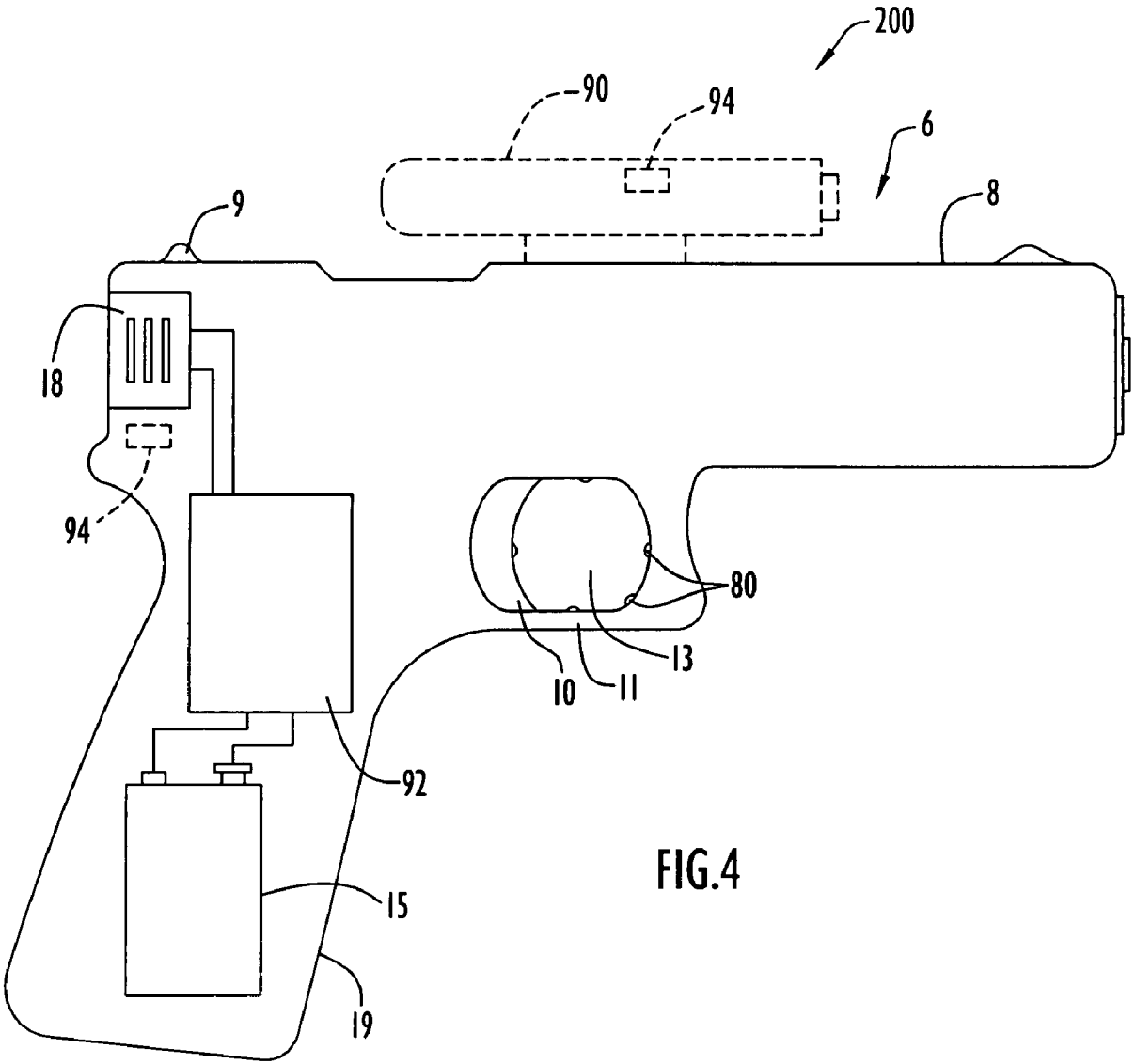
FIG. 4 is a view in elevation of an exemplary firearm employing an alternative embodiment of the firearm monitoring system according to the present invention.

An alternative embodiment of the firearm monitoring system is illustrated in FIG. 4. Specifically, firearm 6 is substantially similar to the firearm described above and, by way of example only, includes barrel 8, hammer 9, trigger 10 disposed within trigger guard 11 and grip 19. Firearm monitoring system 200 is similar to firearm monitoring system 100 described above and includes one or more sensors 80, a circuit board 92 including sensor control circuitry, power source or battery 15 and alarm unit 18. Further, the firearm monitoring system may include or be coupled to laser sighting system 90 and/or radio unit 94. The laser sighting system may be disposed above barrel 8 to project a laser beam indicating a potential impact location due to firearm actuation as described above. The radio unit (and associated circuitry) may be disposed within firearm 6 adjacent alarm unit 18 or, alternatively, may be disposed within a firearm accessory, such as laser sighting system 90, to transmit a warning message or distress signal as described above. Firearm 6 may alternatively be implemented by any conventional actual or mock firearms (e.g., hand-gun, rifle, shotgun, etc.).

Sensors 80 are disposed within and/or on the interior surface of trigger guard 11 and/or the exterior surface of trigger 10. The sensors are preferably implemented by conventional pressure or contact sensors and detect contact or pressure applied by a user finger to trigger 10 and/or trigger guard 11. The sensors may be disposed at any suitable locations within the trigger guard area (e.g., on or within the trigger guard perimeter, trigger, etc.) and be configured to be responsive to any degree of pressure or contact sufficient to detect the presence of a user finger in that area. The sensors are coupled to sensor control circuitry on circuit board 92. The circuit board receives and distributes power from power source or battery 15, and processes the output from sensors 80, generates output timings appropriate for alarm unit 18, laser sighting system 90 and/or radio unit 94, and drives the alarm unit, laser sighting system and/or radio unit to indicate the sensed condition as described below.

Alarm unit 18 is preferably implemented by a buzzer, but may be implemented by any suitable audio and/or visual indicator (e.g., LED, buzzer, speaker, display, etc.). The alarm unit is disposed at the proximal end of the firearm toward hammer 9 and is coupled to circuit board 92. When a user places a user finger in the trigger guard, the finger placement is detected by one or more sensors 80. The presence of the user finger within the trigger guard area is detected by the sensor control circuitry and an alarm may be produced by alarm unit 18 to indicate improper handling of the firearm during a training activity. Further, the firearm monitoring system may actuate laser sighting system 90 to produce a laser transmission (e.g., red-dot, etc.) to indicate the placement of the user trigger finger proximate the trigger during the training activity, while radio unit 94 may transmit a warning message or distress signal in response to this finger placement when the firearm is employed in the field as described above.

Firearm 6 may be implemented as a mock or training firearm with the components of the firearm monitoring system (e.g., sensors 80, circuit board 92, battery 15, alarm unit 18, laser sighting system 90, etc.) mounted on and/or within the firearm components (e.g., trigger 10, trigger guard 11, grip 19, etc.) in the manner described above, and/or mounted on external surfaces of and/or adjacent corresponding firearm components (e.g., trigger 10, trigger guard 11, grip 19, etc.) to detect the presence of a user finger within the trigger guard area in the manner described above. Alternatively, the firearm monitoring system components (e.g., sensors 80, circuit board 92, battery 15, alarm unit 18, laser sighting system 90, radio unit 94, etc.) may be mounted on external (or internal) surfaces of and/or adjacent corresponding components of an actual firearm or other weapon (e.g., trigger 10, trigger guard 11, grip 19, etc.) to detect the presence of a user finger within the trigger guard area in the manner described above in order to enable monitoring of an actual weapon (e.g., a user may train with their own firearm or other weapon, warning or distress messages may be sent during use of the firearm in the field, etc.).

Figure 5:
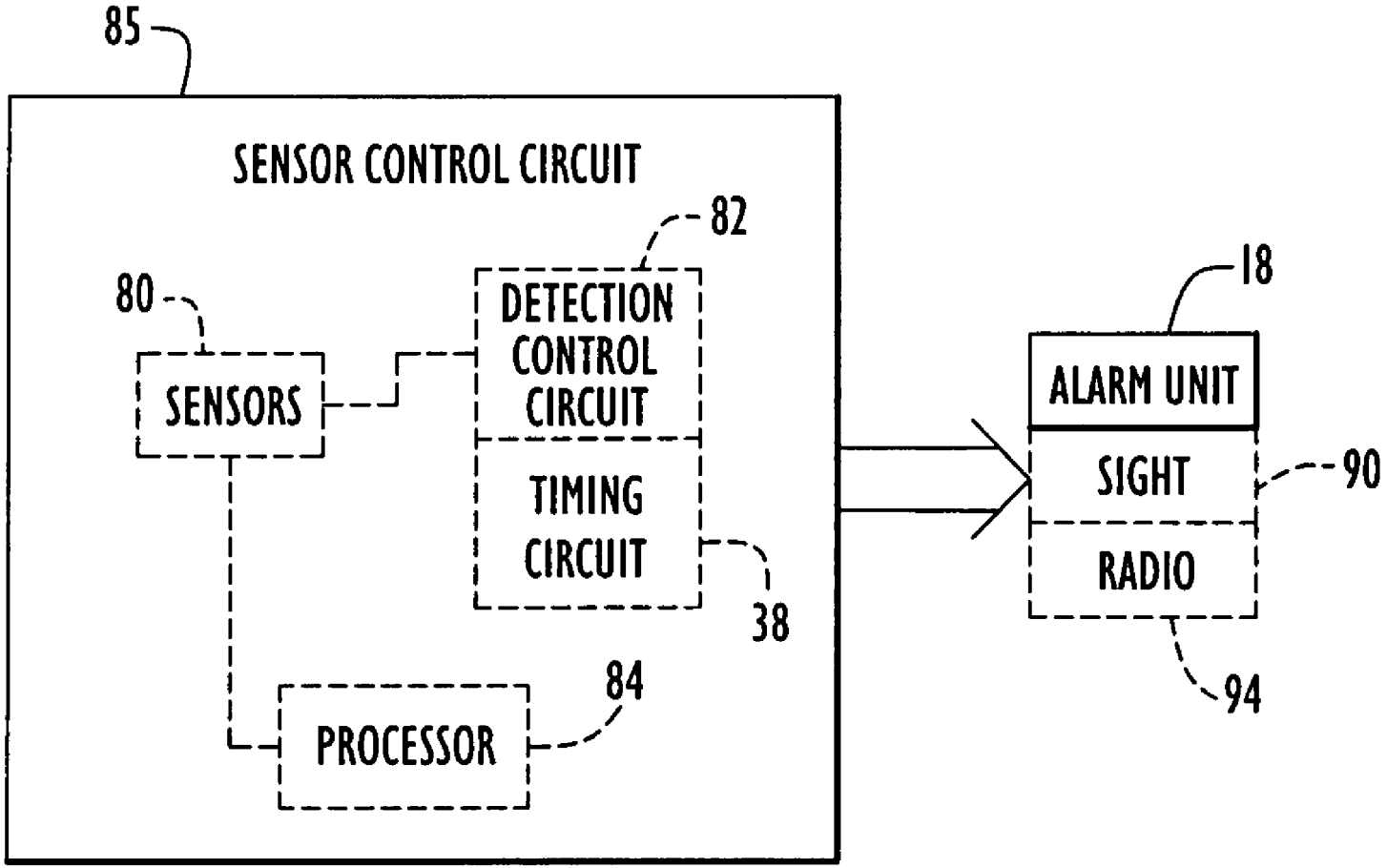
FIG. 5 is a block diagram of the control circuitry of the firearm monitoring system of FIG. 4.

An exemplary sensor control circuit of circuit board 92 for firearm monitoring system 200 according to the present invention is illustrated in FIG. 5. Sensor control circuit 85 processes information from sensors 80 to generate signals appropriate to drive alarm unit 18 or other device (e.g., laser sighting system 90, radio unit 94, warning device, control device, data logging or recording device, etc.). Specifically, control circuit 80 includes a detection control circuit 82 to process signals received from sensors 80, and timing circuit 38 to generate appropriate signals to drive the alarm unit, laser sighting system and/or radio unit.

Figure 6:
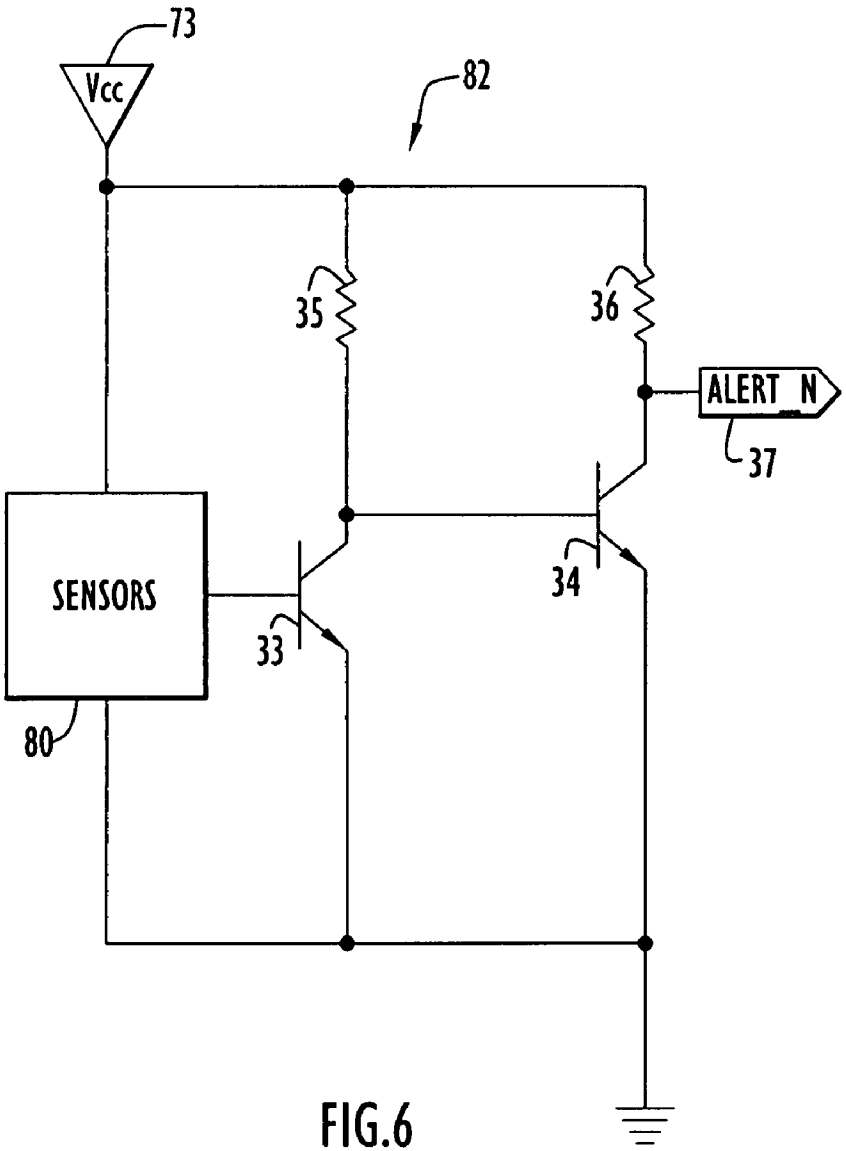
FIG. 6 is an electrical schematic diagram of the detection control circuit of the firearm monitoring system of FIG. 4.

Referring to FIG. 6, detection control circuit 82 is substantially similar to reception control circuit 72 (FIG. 2) described above and includes sensors 80 in place of light detector 17. The outputs of sensors 80 may be combined and/or processed in any suitable fashion (e.g., logic OR or other operations, inverted, etc.) by any conventional or other devices (e.g., gates, circuitry, etc.) within or coupled to the sensors, and are provided to the base of inverting transistor 33 to generate appropriate signals for timing circuit 38. This enables the detection control circuit to produce suitable signals for timing circuit 38 in response to a detection by any quantity of sensors 80.

Briefly, when sensors 80 do not detect the presence of a user finger, the resulting sensor output voltage is sufficient to bias inverting transistor 33 to conduct current from resistor 35 coupled to supply voltage 73 (Vcc) and reduce the voltage at the base of transistor switch 34 to approximately zero volts. This causes the transistor switch to enter an off state and produce a high output signal at collector 37 of transistor switch 34. However, when a user finger or other obstruction is present within the trigger guard area, the sensors detect the presence of the finger, thereby causing the voltage provided from sensors 80 to the base of inverting transistor 33 to be reduced to approximately zero volts. Consequently, the collector of inverting transistor 33 transitions to a high voltage, and bias current is supplied to the base of transistor switch 34 from resistor 35 coupled to supply voltage 73 (Vcc). This causes transistor switch 34 to saturate and supply power to the output load or resistor 36, thereby producing an active low output signal at collector 37.

Timing circuit 38 is substantially similar to the timing circuit (FIG. 3) described above and generates appropriate signals to drive alarm unit 18, laser sighting system 90 and/or radio unit 94. Basically, when sensors 80 do not detect the presence of a user finger within the trigger guard area, a high output signal is generated by detection control circuit 82 as described above and provided to differentiator 76 of timing circuit 38. The resulting conditioned signal (e.g., a high signal) produced by differentiator 76 is applied to trigger input 61 of timer 41 as described above. Since this signal is insufficient to trigger timer 41 as described above, the timer produces a low level logic signal at timer output 64, thereby maintaining alarm unit 18, laser sighting system 90 and/or radio unit 94 in a disabled state.

However, in response to detection of a user finger in the trigger guard area by one or more sensors 80, an output active low signal is generated by reception control circuit 82 as described above and provided to differentiator 76 of timing circuit 38 for conditioning. The resulting short duration or conditioned pulse (e.g., low or negative level) produced by differentiator 76 is applied to trigger input 61 of timer 41 (e.g., with capacitor 43 initially discharged), thereby controlling the timer to produce a high level logic signal at timer output 64 and drive alarm unit 18, laser sighting system 90 and/or radio unit 94 to provide an alarm or warning indication, laser beam transmission and/or warning message or distress signal transmission, respectively. Capacitor 43 begins charging toward the supply voltage (Vcc) and, upon reaching a sufficient level, provides a suitable signal on threshold input 62 (and discharge input 63) to cause timer 41 to produce a low level logic signal at timer output 64 and discharge capacitor 43 (e.g., to initialize the capacitor for the next cycle). The low level logic signal disables the alarm unit, laser sighting system and/or radio unit. The timer basically produces a positive pulse that drives the alarm unit, laser sighting system and/or radio unit to respectively produce an alarm indication, a laser transmission and a warning message transmission during the width of each pulse (e.g., the time interval a generated pulse remains in the high level logic state) as described above. The duration of the warning signal or transmission, generated by alarm unit 18, laser sighting system 90 and/or radio unit 94, is controlled by the characteristics of resistor 42 and capacitor 43 (e.g., controlling the charge time of the capacitor to trigger the threshold input). A variable resistance may be applied to timer 41 (e.g., resistor 42 may be a variable resistor, etc.) to control the charge time of capacitor 43 and enable adjustment of warning signal durations and transmissions (e.g., from zero (e.g., warning disabled) to several seconds, provide flash or beeps, etc.).

The sensor control circuitry may alternatively include a processor 84 (FIG. 5) (e.g., microprocessor, controller, etc.) to process signals received from sensors 80 and produce appropriate signals to drive alarm unit 18, laser sighting system 90, radio unit 94 and/or other devices (e.g., for a predetermined time interval, during the interval a user finger is detected, etc.). In addition, the alarm unit, laser sighting system and/or radio unit may serve as the output load within detection control circuit 82 and be driven by transistor switch 34 to be actuated during the interval a user finger is detected within the trigger guard area in substantially the same manner described above.

Operation of firearm monitoring system 200 is described with reference to FIGS. 4-6. Initially, a user grips firearm 6 in an appropriate manner to perform a drill, exercise or other activity for training purposes, or in response to a situation arising when employed in the field. During the training activity, the user handles the firearm in a manner for firearm actuation. The proper procedure is to move the firearm into a ready position for firing with a user finger outside the trigger guard area. In the case of a situation in the field, the user may place the finger in an appropriate position to discharge the firearm.

While the user maintains the user finger outside the trigger guard area, sensors 80 do not detect the presence of the user finger in the trigger guard area and a high output signal is generated by detection control circuit 82 (FIG. 6) as described above. The high output signal is provided to timing circuitry 38. Since this signal is insufficient to trigger the timing circuitry, the circuitry produces a low level logic signal to maintain alarm unit 18, laser sighting system 90 and/or radio unit 94 in a disabled state as described above.

However, when the user places a finger in the trigger guard area, one or more sensors 80 detect the presence of the finger. Detection control circuit 82 processes the sensor signals and produces an active low output signal that is provided to timing circuitry 38. The timing circuitry generates an appropriate waveform to drive alarm unit 18, laser sighting system 90 and/or radio unit 94 to provide a suitable indication (e.g., audio and/or visual, transmission, etc.) of the user finger placed proximate the trigger. This may indicate improper handling of the firearm during a training activity, or a situation in the field likely to result in discharge of the firearm by the user.

It will be appreciated that the embodiments described above and illustrated in the drawings represent only a few of the many ways of implementing a method and apparatus for monitoring handling of a firearm.

The firearm monitoring systems may be utilized with any type of actual or dummy (e.g., training or mock and incapable of firing live projectiles, etc.) firearm or other weapon including trigger actuation (e.g., hand-gun, rifle, shotgun, machine gun, cross-bow, flame-thrower, etc.). The monitoring systems may utilize any conventional transmitters and detectors emitting and detecting any type of energy (e.g., optical, light, infrared, RF, magnetic, sound or acoustics, mechanical waves or vibrations, etc.), and may accommodate a variety of usage environments (e.g., thermal, RFI, EMI, audio and/or light spectrum background interference, etc.). The monitoring systems may be available in the form of kits for installation on an actual or training weapon, and/or may be available as a weapon (e.g., an actual or dummy weapon) including system components integrated therewith and/or mounted thereon.

The light source may be implemented by any quantity of any conventional or other devices (e.g., LEDs, laser modules, vibrators, speakers, etc.) transmitting any suitable energy wave (e.g., optical, light, infrared, RF, magnetic, sound or acoustics, mechanical waves or vibrations, etc.). The light source may be disposed at any suitable location on or within the weapon (e.g., trigger guard, barrel, grip, etc.) via any conventional or other techniques (e.g., brackets, adhesives, clamps, etc.) and may be oriented or positioned in any fashion to enable reception of an emitted signal by the detector. The emitted light or other energy may be visible or invisible (e.g., white light, infrared, etc.), may be of any color or power level, may have a pulse of any desired duration and may be modulated in any fashion (e.g., at any desired frequency or unmodulated) or encoded in any manner to provide any desired information.

The light detector may be implemented by any quantity of any conventional or other detection devices (e.g., receiver, sensors, microphones, etc.) receiving and detecting any suitable energy wave (e.g., optical, light, infrared, RF, magnetic, sound or acoustics, mechanical waves or vibrations, etc.). The light detector may be disposed at any suitable location on or within the weapon (e.g., trigger guard, trigger, barrel, grip, etc.) via any conventional or other techniques (e.g., brackets, adhesives, clamps, etc.) and may be oriented or positioned in any fashion to enable reception of an emitted signal by the light source. The detector may be configured to detect the emitted light or other energy beam including any characteristics (e.g., modulation, frequency, encoding, etc.).

The sensors may be implemented by any quantity of any conventional or other sensing devices detecting any desired characteristics of a user finger, hand or other body portion. The systems may be designed with one or more hand or finger position sensors to detect either correct or incorrect hand or finger placement on the weapon for training. The sensors may be implemented by any suitable sensor type (e.g., optical, inductive, capacitive, thermal, resistive, ultrasonic, motion, pressure (e.g., mechanical, sound, force, etc.), etc.) and may be disposed at any suitable locations on or within the weapon (e.g., trigger guard, trigger, barrel, grip, etc.) via any conventional or other techniques (e.g., brackets, adhesives, clamps, etc.) and may be oriented or positioned in any fashion to enable detection of the user hand, finger or other body portion. Additional sensors and/or logic may be employed to accommodate both right and left handed users. In addition, supplemental materials may be employed for placement on the user hand and/or finger to aid in the detection of hand and finger position.

The tubular member may be of any quantity, shape, size or length, and may be constructed of any suitable materials molded or cast within the weapon. The tubular member may be disposed at any suitable locations on or within the weapon (e.g., trigger guard, trigger, barrel, grip, etc.) via any conventional or other techniques (e.g., brackets, adhesives, clamps, etc.) and may be oriented or positioned in any fashion to enable reception of an emitted signal by the light source. The light detector may be positioned at any suitable location on or within the tubular member, or may be utilized without the tubular member to receive the emitted signal. The tubular member may be hollow or include a channel of any quantity, shape or size to enable the emitted signal to pass therethrough. The channel may extend in any suitable directions. The tubular member interior may include any coating or other surface to reduce noise and/or interference (e.g., dark color, filters, etc.), and/or filters may be employed by the systems for noise reduction.

The alarm unit may be implemented by any quantity of any conventional or other suitable devices providing a warning or alarm indication (e.g., audio, visual, speaker, buzzer, lights or LEDs, display, etc.). The alarm unit or other devices may be disposed at any location on or remote from the weapon and receive signals in any manner (e.g., wires, wireless, etc.). The monitoring systems may further actuate and/or be coupled to any suitable systems (e.g., laser sighting system, control system, data recordation or logging system, etc.).

The laser sighting system may be implemented by any conventional or other sighting or transmission devices projecting a laser or other energy beam (e.g., light, etc.). The laser sighting system may be disposed at any suitable location on the weapon via any conventional or other techniques (e.g., brackets, adhesives, clamps, etc.).

The radio unit may be implemented by any conventional or other radio, transmitting or transceiving devices transmitting information (e.g., message, signal, etc.) in any suitable energy form (e.g., IR, RF, etc.) and at any desired frequencies. The signal may contain any desired information or codes, and may be modulated and/or encoded in any fashion (e.g., modulated, unmodulated, encrypted, etc.). The radio unit may transmit messages any suitable distances (e.g., locally to nearby devices, remotely to equipment located at further distances, etc.) and to any suitable equipment (e.g., computer systems, relay systems, etc.). The radio unit may be disposed at any suitable location on or within the weapon or a weapon accessory (e.g., laser sighting system, etc.) via any conventional or other techniques (e.g., brackets, adhesives, clamps, etc.). The radio unit may be employed to interface any existing organization communications equipment and may be utilized for various applications (e.g., law enforcement, security, military, entertainment, training or gaming applications, etc.).

The alarm unit or other devices (e.g., laser sighting system, radio unit, control system, data recordation or logging system, etc.) may be employed either individually, or in any combinations, for any training, field or other applications, and may be actuated for any desired time interval in response to detection of a user finger or hand, or may be actuated during the interval the user finger or hand is detected by the system.

The control circuitry may include any quantity of conventional or other components (e.g., gates, resistors, capacitors, transistors, IC devices, etc.) arranged in any fashion to perform the functions described herein. The supply voltage may provide any suitable voltage to the circuit. The systems may be powered by the battery or other portable power source, or may be configured to receive power from a common wall outlet jack. The control circuitry may generate any suitable signals of any desired levels or values and in any form (e.g., analog, digital, active high, active low, etc.) to perform the functions described herein (e.g., drive the timing circuit, drive the alarm unit or other device, indicate detection of the emitted beam, etc.). The signals may have any desired values to drive other circuits or devices (e.g., active high, active low, etc.), while the circuitry (e.g., transmission control circuit, reception control and detection control circuits, timing circuit, etc.) may be implemented utilizing any desired logic or polarities (e.g., inverted and/or non-inverted logic, NPN or PNP bipolar transistors, MOS transistors, etc.).

The transmission control circuit may include any quantity of any conventional or other components (e.g., gates, resistors, capacitors, etc.) arranged in any fashion to control emission of the beam. The oscillator may be implemented by any conventional or other oscillator or circuitry and may modulate the emitted beam in any suitable fashion (e.g., any desired frequency, encoding, etc.). The buffer may be implemented by any conventional or other buffer or circuitry. The gates may be implemented by any quantity of any conventional or other components (e.g., transistors, diodes, IC devices, gate arrays, etc.) and may be arranged for any suitable logic schemes (e.g., TTL, ECL, etc.). Alternatively, the transmission control circuit may include a conventional 555 timer used and configured as an oscillator to generate the output voltage varying at any desired frequency. The circuit components may include any desired characteristics (e.g., resistance, capacitance, any types of transistors (e.g., NPN, PNP, FET, etc.), etc.).

The reception control and detection control circuits may include any quantity of any conventional or other components (e.g., resistors, capacitors, transistors, etc.) arranged in any fashion to process a received beam. The components of the circuits may include any desired characteristics (e.g., resistance, capacitance, any types of transistors (e.g., NPN, PNP, FET, etc.), etc.) and may provide signals for the timing circuit of any desired levels or values (e.g., high, low, analog, digital, etc.).

The timing circuit may include any quantity of any conventional or other components (e.g., gates, resistors, capacitors, etc.) arranged in any fashion to provide any suitable signals of any desired level or value (e.g., high, low, analog, digital, etc.) to drive the alarm unit or other device (e.g., laser sighting system, radio unit, data recordation or logging system, control system, etc.). The differentiator may be implemented by any conventional or other differentiator or circuitry and may condition a signal to any desired level or form (e.g., pulse of any desired level, duration or frequency, etc.). The timer may be implemented by any conventional or other timer or circuitry (e.g., transistors, IC devices, processor, logic or gate arrays, etc.) and may provide signals in any suitable form (e.g., pulse train of any frequency, waveform, high, low, analog, digital, etc.). The circuit components may include any desired characteristics (e.g., resistance, capacitance, etc.). The timing circuit may be configured to alter the behavior of the alarm or other device in any fashion (e.g., alter the temporal conditions required to activate or reset the alarm or device, alter the interval of alarm or other device actuation, etc.).

It is to be understood that the present invention is not limited to the applications described above, but may be utilized for any weapons for any suitable purposes (e.g., military, law enforcement, civilian training, security, etc.). Further, the present invention may employ any suitable sensing and notifying arrangements to indicate the presence of a user finger, hand or other body portion in the proximity of a trigger of an actual or training weapon. Moreover, the various components of the systems (e.g., sensors, detector, control circuitry, alarm unit or other device, etc.) may be local to or remote from each other and transfer signals in any desired fashion (e.g., wired, wireless, etc.).

From the foregoing description, it will be appreciated that the invention makes available a novel method and apparatus for monitoring handling of a firearm, wherein a firearm monitoring device senses the position of a user hand or trigger finger and produces an alarm or transmission in response to detecting placement of the trigger finger proximate the firearm trigger.

Having described preferred embodiments of a new and improved method and apparatus for monitoring handling of a firearm, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A monitoring system to monitor user handling of a weapon including a trigger guard with a trigger disposed therein and a trigger area defined by an exterior surface of said trigger and a plurality of interior surfaces of said trigger guard, wherein said weapon is operated in response to actuation of said trigger and said monitoring system indicates placement relative to said trigger of a user body portion for actuating said trigger, said monitoring system comprising:

a sensing unit mountable to said weapon proximate said trigger to sense the presence of a user body portion for actuating said trigger within said trigger area and in a vicinity of said trigger, wherein said sensing unit includes a plurality of sensing devices disposed on at least two different ones of said surfaces defining said trigger area to detect said user body portion within said trigger area;

an indicator unit including an indicator providing an indication in response to detection of said user body portion within said trigger area by said sensing unit, wherein each actuation of said indicator indicates the presence of said user body portion within said trigger area; and a control unit to generate control signals for said indicator unit to indicate the presence of said user body portion within said trigger area in accordance with said sensing of said user body portion within said trigger area by said sensing unit.

2. The monitoring system of claim 1, wherein said weapon is a firearm, and wherein said sensing unit is mountable within said trigger area to detect the presence of said user body portion within said trigger area.

3. The monitoring system of claim 2, wherein said sensing devices includes:

an emitter to emit an energy signal across said trigger area toward said trigger, wherein placement of said user body portion within said trigger area interrupts emission of said energy signal; and a detector disposed proximate said trigger to receive and detect said emitted energy signal;

wherein said control unit processes signals from said detector and detects the presence of said user body portion in response to interruption of said energy signal.

4. The monitoring system of claim 3, wherein said energy signal includes at least one of an optical signal, an acoustic signal and an electromagnetic signal.

5. The monitoring system of claim 2, wherein said sensing devices includes at least one sensor disposed on at least one of said trigger and a surface of said trigger guard.

6. The monitoring system of claim 5, wherein said at least one sensor includes at least one of an optical sensor, an inductive sensor, a capacitive sensor, a thermal sensor, a resistive sensor, a sound sensor, a motion sensor and a pressure sensor.

7. The monitoring system of claim 1, wherein said control unit generates said control signals to actuate said indicator for a predetermined time interval.

8. The monitoring system of claim 1, wherein said control unit generates said control signals to actuate said indicator during detection of said user body portion.

9. The monitoring system of claim 1, wherein said indicator includes a laser sighting system emitting a laser beam in response to detection of said user body portion by said sensing unit.

10. The monitoring system of claim 1, wherein said weapon includes one of an actual firearm and a mock firearm.

11. The monitoring system of claim 1, wherein said user body portion includes at least one of a finger and a hand.

12. The monitoring system of claim 1, wherein said indicator unit indicates improper placement of said user body portion relative to said trigger during firearm training in response to detection of said user body portion by said sensing unit.

13. The monitoring system of claim 1, wherein said weapon includes an actual firearm and said indicator includes a radio unit to transmit at least one of a warning message and distress signal in response to detection of said user body portion by said sensing unit.

14. A monitoring system to monitor user handling of a weapon, wherein said weapon is a firearm operated in response to actuation of a trigger and includes a trigger guard with said trigger disposed within the confines of said trigger guard, and wherein said monitoring system indicates placement relative to said trigger of a user body portion for actuating said trigger and comprises:

a sensing unit mountable to said weapon proximate said trigger to sense the presence of a user body portion for actuating said trigger in a vicinity of said trigger, wherein said sensing unit is mountable within said trigger guard confines to detect the presence of said user body portion within those confines and includes:

an emitter to emit an energy signal across said trigger guard confines toward said trigger, wherein placement of said user body portion within said trigger guard confines interrupts emission of said energy signal; and a detector disposed proximate said trigger to receive and detect said emitted energy signal;

a tubular member disposed proximate said trigger and oriented to receive said emitted energy signal from said emitter, wherein said detector is disposed at a proximal end of said tubular member to receive said energy signal through said tubular member;

an indicator unit to provide an indication of placement of said user body portion relative to said trigger in response to detection of said user body portion by said sensing unit; and a control unit to generate control signals for said indicator unit in accordance with said sensing of said user body portion by said sensing unit, wherein said control unit processes signals from said detector and detects the presence of said user body portion in response to interruption of said energy signal.

15. A weapon to monitor user handling of said weapon, wherein said weapon indicates placement of a user body portion for actuating said weapon, said weapon comprising:

a frame including a trigger guard with a trigger disposed therein and a trigger area defined by an exterior surface of said trigger and a plurality of interior surfaces of said trigger guard;

a sensing unit disposed proximate said trigger to sense the presence of a user body portion for actuating said trigger within said trigger area and in a vicinity of said trigger, wherein said sensing unit includes a plurality of sensing devices disposed on at least two different ones of said surfaces defining said trigger area to detect said user body portion within said trigger area;

an indicator unit including an indicator providing an indication in response to detection of said user body portion within said trigger area by said sensing unit, wherein each actuation of said indicator indicates the presence of said user body portion within said trigger area; and a control unit to generate control signals for said indicator unit to indicate the presence of said user body portion within said trigger area in accordance with said sensing of said user body portion within said trigger area by said sensing unit.

16. The weapon of claim 15, wherein said weapon is in the form of a firearm, and wherein said sensing unit is disposed within said trigger area to detect the presence of said user body portion within said trigger area.

17. The weapon of claim 16, wherein said sensing devices includes:

an emitter to emit an energy signal across said trigger area toward said trigger, wherein placement of said user body portion within said trigger area interrupts emission of said energy signal; and a detector disposed proximate said trigger to receive and detect said emitted energy signal;

wherein said control unit processes signals from said detector and detects the presence of said user body portion in response to interruption of said energy signal.

18. The weapon of claim 16, wherein said sensing devices includes at least one sensor disposed on at least one of said trigger and a surface of said trigger guard.

19. The weapon of claim 15, wherein said control unit generates said control signals to actuate said indicator for one of a predetermined time interval and during detection of said user body portion.

20. The weapon of claim 19, wherein said indicator includes a laser sighting system emitting a laser beam in response to detection of said user body portion by said sensing unit.

21. The weapon of claim 15, wherein said user body portion includes at least one of a finger and a hand.

22. The weapon of claim 15, wherein said indicator unit indicates improper placement of said user body portion relative to said trigger during firearm training in response to detection of said user body portion by said sensing unit.

23. The weapon of claim 15 wherein said weapon includes an actual firearm and said indicator includes a radio unit to transmit at least one of a warning message and distress signal in response to detection of said user body portion by said sensing unit.

24. A weapon in the form of a firearm to monitor user handling of said weapon, wherein said weapon includes a trigger guard with said trigger disposed within the confines of said trigger guard and indicates placement of a user body portion for actuating said weapon, said weapon comprising:

a frame including a trigger;

a sensing unit disposed proximate said trigger to sense the presence of a user body portion for actuating said trigger in a vicinity of said trigger, wherein said sensing unit is disposed within said trigger guard confines to detect the presence of said user body portion within those confines and includes:

an emitter to emit an energy signal across said trigger guard confines toward said trigger, wherein placement of said user body portion within said trigger guard confines interrupts emission of said energy signal; and a detector disposed proximate said trigger to receive and detect said emitted energy signal;

a tubular member disposed proximate said trigger and oriented to receive said emitted energy signal from said emitter, wherein said detector is disposed at a proximal end of said tubular member to receive said energy signal through said tubular member;

an indicator unit to provide an indication of placement of said user body portion relative to said trigger in response to detection of said user body portion by said sensing unit; and a control unit to generate control signals for said indicator unit in accordance with said sensing of said user body portion by said sensing unit, wherein said control unit processes signals from said detector and detects the presence of said user body portion in response to interruption of said energy signal.

25. A method of monitoring user handling of a weapon, including a trigger guard with a trigger disposed therein and a trigger area defined by an exterior surface of said trigger and a plurality of interior surfaces of said trigger guard, and indicating placement relative to said trigger of a user body portion for actuating said trigger, said method comprising:

(a) sensing the presence of a user body portion for actuating said trigger within said trigger area and in a vicinity of said trigger via a plurality of sensing devices disposed on at least two different ones of said surfaces defining said trigger area; and (b) actuating an indicator providing an indication in response to detection of said user body portion within said trigger area, wherein each actuation of said indicator indicates the presence of said user body portion within said trigger area.

26. The method of claim 25, wherein said weapon is a firearm.

27. The method of claim 25, wherein step (a) further includes:

(a.1) emitting an energy signal across said trigger area toward said trigger, wherein placement of said user body portion within said trigger area interrupts emission of said energy signal; and (a.2) receiving and detecting said emitted energy signal proximate said trigger, wherein the presence of said user body portion is detected in response to sensing interruption of said energy signal.

28. The method of claim 25, wherein step (a) further includes:

(a.1) sensing the presence of said user body portion within said trigger area via at least one of said sensing devices disposed on at least one of said trigger and a surface of said trigger guard.

29. The method of claim 25, wherein step (b) further includes:

(b.1) actuating said indicator for one of a predetermined time interval and during detection of said user body portion.

30. The method of claim 25, wherein said indicator includes a laser sighting system, and step (b) further includes:

(b.1) actuating said laser sighting system to emit a laser beam in response to detection of said user body portion.

31. The method of claim 25, wherein said weapon includes one of an actual firearm and a mock firearm.

32. The method of claim 25, wherein said user body portion includes at least one of a finger and a hand.

33. The method of claim 25, wherein step (b) further includes:

(b.1) actuating said indicator to indicate improper placement of said user body portion relative to said trigger during firearm training in response to detection of said user body portion.

34. The method of claim 25, wherein said weapon includes an actual firearm and said indicator includes a radio unit, and step (b) further includes:

(b.1) transmitting at least one of a warning message and distress signal in response to detection of said user body portion.

35. A method of monitoring user handling of a weapon and indicating placement relative to a weapon trigger of a user body portion for actuating said trigger, wherein said weapon is a firearm including a trigger guard with said trigger disposed within the confines of said trigger guard, said method comprising:

(a) sensing the presence of a user body portion for actuating said trigger in a vicinity of said trigger of said weapon, wherein step (a) further includes:

(a.1) sensing the presence of said user body portion within confines of said trigger guard, wherein step (a.1) further includes:

(a.1.1) emitting an energy signal across said trigger guard confines toward said trigger, wherein placement of said user body portion within said trigger guard confines interrupts emission of said energy signal; and (a.1.2) receiving and detecting said emitted energy signal proximate said trigger, wherein the presence of said user body portion is detected in response to sensing interruption of said energy signal, wherein step (a.1.2) further includes:

(a.1.2.1) receiving said emitted energy signal though a tubular member disposed proximate said trigger; and (b) indicating placement of said user body portion relative to said trigger in response to detection of said user body portion.

* * * * *